United States Patent [19]

Okudaira et al.

[11] Patent Number: 4,902,341

[45] Date of Patent: Feb. 20, 1990

[54] METHOD FOR PRODUCING TITANIUM ALLOY

[75] Inventors: Shigenori Okudaira, Ninomiya; Takefumi Irie; Hiroshi Uchida, both of Chigasaki; Eiichi Fukasawa, Samukawa; Kazuhiko Kobayashi, Chigasaki; Masanori Yamaguchi, Nakai, all of Japan

[73] Assignee: Toho Titanium Company, Limited, Tokyo, Japan

[21] Appl. No.: 234,529

[22] Filed: Aug. 22, 1988

[30] Foreign Application Priority Data

Aug. 24, 1987 [JP] Japan ..... 62-208184

[51] Int. Cl.[4] ..... C22B 34/12; C22C 1/00

[52] U.S. Cl. ..... 75/10.18; 75/84.5

[58] Field of Search ..... 75/10.18, 84.5

[56] References Cited

U.S. PATENT DOCUMENTS

| | | | |
|---|---|---|---|
| 3,775,091 | 11/1973 | Clites et al. | 75/10.17 |
| 3,847,596 | 11/1974 | Holland et al. | 75/84.5 |
| 3,977,866 | 8/1976 | Othmer | 75/84.5 |
| 4,032,328 | 6/1977 | Hurd | 266/200 |
| 4,687,632 | 8/1987 | Hurd, deceased et al. | 75/84.5 |

FOREIGN PATENT DOCUMENTS

| | | | |
|---|---|---|---|
| 46-19761 | 6/1971 | Japan . | |
| 0736852 | 9/1955 | United Kingdom | 75/84.5 |
| 1054162 | 1/1967 | United Kingdom . | |
| 1187367 | 4/1970 | United Kingdom . | |

*Primary Examiner*—L. Dewayne Rutledge
*Assistant Examiner*—David W. Schumaker
*Attorney, Agent, or Firm*—Oblon, Spivak, McClelland, Maier & Neustadt

[57] ABSTRACT

A method for producing titanium alloy by the reduction of titanium tetrachloride and alloy components with a reducing metal agent, capable of continuously producing titanium alloy on an industrial scale. The temperature and pressure of the reaction zone for the reduction are kept above a melting point of the titanium alloy and above the vapor pressure of the reducing metal agent at that temperature respectively, so that the reducing metal agent and its chloride may be kept in a molten state but without boiling.

12 Claims, 2 Drawing Sheets

METHOD FOR PRODUCING TITANIUM ALLOY

BACKGROUND OF THE INVENTION

1. Field of the Invention

The present invention relates to a method for producing titanium alloy, and more particularly to a method for producing titanium alloy by reducing titanium tetrachloride and alloy component metals or their chlorides with a reducing metal agent.

2. Description of the Prior Art

A conventional method for producing titanium alloy generally comprises the steps of preparing a consumable electrode, obtained by mixing sponge titanium particles with alloy component elements, forming the mixture into a block, and melting the consumable electrode in a vacuum arc melting furnace to prepare an ingot of titanium alloy. For example, Ti-6Al-4V alloy is produced by crushing sponge titanium obtained by the Kroll process into particles and mixing this with Al-V alloy and Al in pellet form. The mixture is subjected to press to form briquettes which are in turn welded in an inert atmosphere to form an electrode to be melted in the vacuum arc melting furnace to obtain an ingot of the alloy. This conventional consumable electrode type arc melting method therefore cannot continuously produce the alloy because a consumable electrode must be prepared by mixing sponge titanium with alloy component elements and forming the mixture into a compact shape. Thus, the arc melting method requires at least four steps, namely, a reduction step, a separation step, a crushing and mixing step and a melting step, which are all quite independent, in the production of a metallic titanium ingot.

Thus, the production of titanium alloy by the consumable electrode type arc melting method generally has the following disadvantages.

It cannot operate continuously from the production of titanium sponge by metal halide reduction to the melting of metallic titanium, resulting in several complicated separate steps being required to produce the titanium alloy.

The titanium sponge produced in the reduction step tends to be contaminated with the material of the reaction vessel because it is very reactive.

The titanium sponge tends to be contaminated with moisture and air in the separation and purification step.

Furthermore, there is considerable increase in equipment, energy and labour costs.

Another method for the production of titanium alloy by the reduction of a metal halide with a reducing metal agent is known in which the reaction temperature is maintained above the melting point of the titanium alloy to be produced by addition of alloy component metals or their chlorides, resulting in the titanium alloy being produced in a molten states. The molten titanium alloy product is then removed as a melt.

Alternatively, the product can be cooled to solidification in a reducing vessel and then continuously drawn out in the form of a ingot from the vessel.

As an example, Japanese Patent Application Laid-Open publication No. 35733/1981 discloses a method for producing an alloy by reacting a halide of a metal reactant particularly its chloride, with a reducing agent at a temperature above the melting point of the alloy to be produced. The alloy is solidified as it is drawn out from the reaction zone where reduction takes place. The alloy is kept in a liquid state within the reaction zone at a temperature above the boiling or sublimation point of the other reaction products at the pressure for the reduction, while the other reaction products are kept in gas form and substantially continuously drawn out the reaction zone.

Also, Japanese Patent Publication No. 19761/1971 discloses a method for producing an alloy by reducing a metal halide with a reducing metal at a temperature above a melting point of the alloy to be produced. In this case, the reduction takes place in a closed reaction zone in a reaction vessel at a pressure which is at least equal to the vapour pressure of the halide of the reducing metal.

Various other similar methods have attempted to solve the problems of the consumable electrode type arc melting method by keeping the reaction temperature above the melting point of the alloy to be produced during reduction of a metal halide with a reducing metal agent. Although these methods are disclosed in the patent literature, they have not been commercialized on an industrial scale.

The main reason is believed to be the difficulty in selecting a material for the reaction vessel which can withstand a sufficiently high temperature to keep high melting point reactive metals such as titanium, zirconium, or the like in a molten state.

The above-described method disclosed in Japanese Patent Publication No. 19761/1971 is to reduce chlorides of alloy component metals including titanium tetrachloride with magnesium to produce titanium alloy in a reaction zone while keeping the temperature of the reaction zone above the melting point of the titanium alloy and the pressure of the reaction zone above the partial pressure of the magnesium chloride by-product at that temperature. Unfortunately, under these conditions, the magnesium boils resulting in a failure to provide sufficient magnesium to reduce completely the chlorides of the alloy component metals, including titanium tetrachloride, in the reaction zone. This often leads to the production of titanium subchlorides such as titanium trichloride and titanium dichloride.

Also, in this method, the reactants, including titanium tetrachloride and magnesium, are supplied through graphite pipes to a molten layer of the reaction product at the bottom of the reaction vessel, so that the reaction takes place in the molten layer. This causes the ends of the graphite pipes to be corroded by the active molten titanium alloy product. In addition, the molten titanium alloy product contacts the reactants at a relatively low temperature at the open end of the pipes, solidifying the reactants and so clogging the pipes. Furthermore, since the reaction takes place in the molten layer of titanium alloy, the titanium alloy product is contaminated with unreacted reactants, by-products and the like. Finally, insufficient magnesium in the reaction zone leads to a decrease in reaction efficiency.

SUMMARY OF THE INVENTION

The present invention has been made in view of the foregoing disadvantages of the prior art.

Accordingly, it is an object of the present invention to provide a method for producing titanium alloy ingot directly by the reduction of titanium tetrachloride, together with alloy component metals or their chlorides, which is capable of continuously producing titanium alloy of high quality, at a low cost and on an industrial scale.

According to the present invention, there is provided a method for producing a titanium alloy comprising titanium and at least one other alloy component metal in which titanium tetrachloride is reduced using a reducing metal agent, comprising the steps of: maintaining a reaction zone in a reaction vessel at a temperature above the melting point of the titanium alloy to be produced and at a pressure at least above the vapour pressure of the reducing metal agent at that temperature; supplying the titanium tetrachloride, the reducing metal agent and the alloy component metals in metal form or in compound form to the reaction zone for reaction to produce the titanium alloy product and a chloride by-product of the reducing metal agent; separating the product and by-product from each other in the molten state; collecting the titanium alloy product at the bottom of the vessel; and continuously drawing out the titanium alloy product from the reaction vessel.

According to one preferred form of the invention, there is provided a method for producing a titanium alloy by the reduction of titanium tetrachloride and at least one other metal chloride with a reducing metal agent, comprising the steps of: maintaining a reaction zone in a reaction vessel at a temperature above the melting point of the titanium alloy to be produced and at a pressure at least above the vapour pressure of the reducing metal agent at that temperature; supplying the metal chlorides and the reducing metal agent to the reaction zone for reaction to produce the titanium alloy product and a chloride by-product from each other in the molten state; collecting the titanium alloy product at the bottom of the reaction vessel; and continuously drawing out the titanium alloy product from the reaction vessel.

According to another preferred form of the invention, there is provided a method for producing a titanium alloy by the reduction of titanium tetrachloride with a reducing metal agent, in which alloy component metals are added, comprising the steps of: maintaining a reaction zone in a reaction vessel at a temperature above the melting point of the titanium alloy to be produced and at a pressure at least above the vapour pressure of the reducing metal agent at that temperature; supplying the titanium tetrachloride and the reducing metal agent together with the alloy component metals to the reaction zone for reaction to produce the titanium alloy product and a chloride by-product of the reducing metal agent; separating the product and by-product from each other in the molten state; collecting the titanium alloy product at the bottom of the reaction vessel; and continuously drawing out the titanium alloy product from the reaction vessel.

Preferably the reaction vessel is provided with electromagnetic heating means. Preferably, the titanium alloy product is solidified by cooling as it is withdrawn to form an ingot. The method preferably also includes the step of melting the separated titanium alloy product into a molten bath of titanium alloy previously formed on a bottom of the reaction vessel prior to withdrawing the titanium alloy product.

The present inventors made a great deal of effort to develop a method for continuously producing titanium alloy in a molten state, while keeping the temperature of the reaction zone above the melting point of the metallic titanium alloy.

As a result, the present invention has been made taking notice of the fact that a titanium alloy of high quality and free of contamination with the material of the reaction vessel can be obtained at high yields by reacting titanium tetrachloride and alloy component metals or their chlorides with a reducing metal agent in a substantially liquid phase in a reaction zone kept at a high temperature and pressure and by providing electromagnetic induction heating means and cooling means for the reaction vessel for reducing the titanium tetrachloride and the alloy component metals or their chlorides, for heating, melting and separating the titanium alloy product and the chloride by-product of the reducing metal agent and for solidifying the titanium alloy product by cooling.

The reaction vessel used in the method of the present invention may be made of a metal such as copper or the like or a ceramic such as alumina, zirconia or the like and is preferably an elongate hollow generally cylindrical shape open at its upper and lower portions. The reaction vessel is preferably formed with a path for circulating a cooling agent for cooling an inner surface of the reaction vessel, and preferably has electromagnetic induction heating means for heating the melt in the reaction vessel on its outer periphery.

An example of a reaction vessel equipped with such electromagnetic induction heating means is disclosed in U.S. Pat. No. 3,775,091 which shows a crucible in an evacuated inert atmosphere, adapted to melt titanium chips, sponge titanium or the like for preparing a titanium ingot. In the present invention, such a crucible may be incorporated within a pressure vessel, where it constitutes the reaction vessel which provides the reaction zone for the reduction reaction, and a mould section for solidifying the titanium alloy product by cooling and from which the titanium alloy product is drawn out.

The temperature of the reaction zone is required to be above the melting point of titanium alloy. However, in order to precipitate the titanium alloy product onto the bottom of the reaction vessel while keeping it in a molten state, the temperature is preferably kept at a level exceeding melting point by about 100°-200° C. while the pressure of the reaction zone is kept at a level above at least the vapour pressure of the reducing metal agent at that temperature and preferably above the sum total of vapour pressures of the reducing metal agent and its chloride.

Furthermore, in the present invention, it is preferable that the alloy component metals or their chlorides, the titanium tetrachloride and the reducing metal agent should be supplied to the reaction zone in liquid form. Magnesium or sodium is preferably used as the reducing metal agent.

BRIEF DESCRIPTION OF THE DRAWINGS

The invention may be carried into practice in various ways and some embodiments will now be described by way of example with reference to the accompanying drawings; in which.

DETAILED DESCRIPTION OF THE PREFERRED EMBODIMENT

Figure 1:
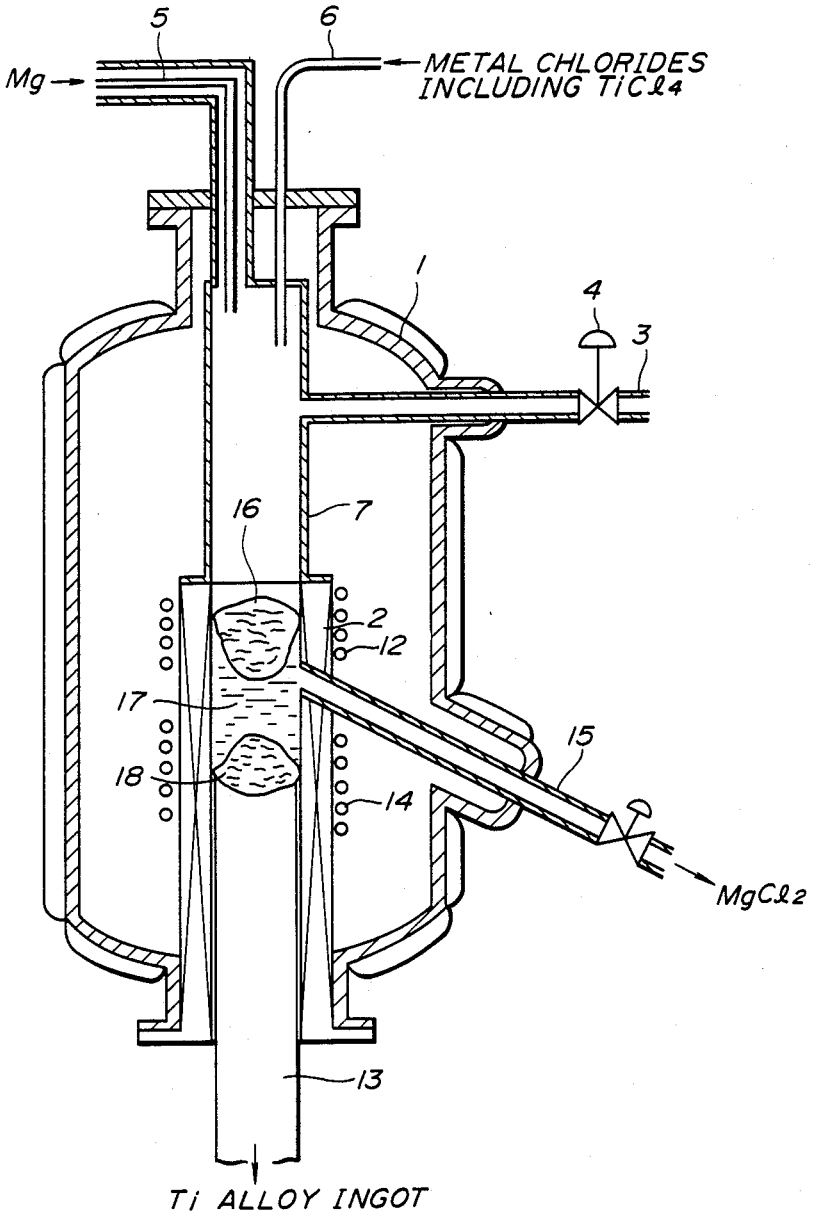
FIG. 1 is a vertical sectional view generally showing an apparatus suitable for use in carrying out a method for producing titanium alloy according to the present invention.

The apparatus as shown in FIG. 1 includes a pressure vessel 1 and a reaction vessel 2 located within the pressure vessel 1.

An inert gas such as argon is introduced into the reaction vessel 2 through a pressure adjusting pipe 3, so that the reaction vessel 2 may be kept at a required pressure substantially to prevent boiling of magnesium and magnesium chloride, even when the temperature in a reaction zone in the reaction vessel is above the melting point of the titanium alloy to be produced. Thus, for example, when the reaction zone (bath) temperature is 1827° C., which is the above described preferred temperature, the reaction vessel is kept at a pressure of about 50 atms. If the pressure in the reaction vessel goes above or below the set value, an automatic pressure adjusting valve 4 arranged in a pressure adjusting pipe 3, is actuated to maintain the pressure at the set value.

Magnesium in liquid form is supplied from a feed pipe 5 through a guide cylinder 7 extending between the feed pipe 5 and the upper portion of the reaction vessel 2 to the reaction zone in the reaction vessel 2. Similarly, at least two metal chlorides, including titanium tetrachloride as the base metal compound are supplied from a feed pipe 6 through the guide cylinder 7 to the reaction zone in the reaction vessel 2.

When the alloy component metals are directly added as their chlorides, the alloy component elements may be supplied from the feed pipe 6 through the guide cylinder 7 to the reaction zone while suspended in the titanium tetrachloride. Alternatively, they may be supplied by means of a separate feed pipe.

Figure 2:
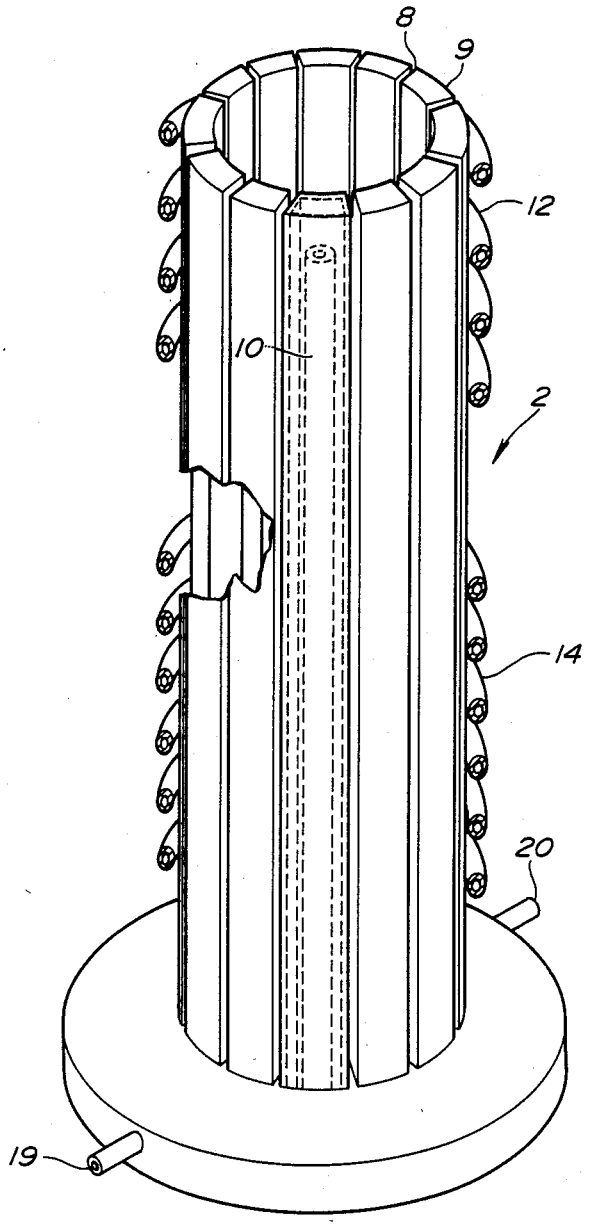
FIG. 2 is a partially cutaway perspective view generally showing one embodiment of a reaction vessel incorporated in the apparatus shown in FIG. 1.

The reaction vessel, as shown in FIG. 2, is a vertically extending elongate, hollow generally cylindrical shape whose top and bottom are open. It is made of copper or a similar suitable material. It is divided into two or more hollow segments 9 by means of vertically extending slits 8 formed through the wall of the reaction vessel 2. In the illustrated embodiment, the reaction vessel 2 is divided into twelve such segments 9. Each of the slits 8 is filled with a heat-resistant and electrically insulating material to isolate the segments 9 from one another electrically. Each of the segments 9 is provided with an internal cooling pipe 10 for cooling its inner surface and therefore the inner surface of the reaction vessel. The cooling pipes 10 are connected to one another to form a circulation path along which a cooling agent passes from an inlet 19 to an outlet 20.

The reaction vessel 2 is equipped, on the outer periphery of its upper portion, with an upper electromagnetic induction heating coil 12 for heating the reaction vessel to elevate the temperature of the reaction zone in the reaction vessel 2 to a level above the melting point of the titanium alloy to be produced. The reaction vessel 2 is also provided, on the outer periphery of a lower region with a lower electromagnetic induction heating coil 14. This is arranged to heat the top of an ingot 13 having the same composition as the titanium alloy to be produced which is charged into the reaction vessel 2 through its bottom prior to the beginning of the titanium alloy production.

The segments 9 which constitute the reaction vessel 2 are electrically isolated from one another and individually cooled, thereby substantially preventing eddy currents flowing therethrough due to electromagnetic induction by the upper and lower electromagnetic induction heating coils 12 and 14. Accordingly, the coils effectively heat only the reactants supplied to the reaction zone in the reaction vessel 2, without heating the reaction vessel 2 itself.

A discharge pipe 15 leads out from a substantially central part of the reaction vessel 2, corresponding to the reaction zone. Magnesium chloride, which is the by-product of the reduction, is discharged from the reaction system via this discharge pipe.

In the illustrated embodiment, the reaction vessel 2 is made of a metal such as copper in view of its cost, its ease of maintenance etc. However, it may be made of a ceramic material such as alumina or zirconia or the like, in which case, the reaction vessel need not be divided into segments.

The production of a titanium alloy using the apparatus described above will now be described.

The titanium alloy ingot 13 is inserted in through the lower open end of the reaction vessel 2 thereby closing the lower end. The reaction vessel 2 is charged with magnesium and magnesium chloride in small amounts and is then purged with argon gas after evacuated.

Then, the top of the titanium alloy ingot 13 is heated using the lower coil 14 and the magnesium and magnesium chloride are heated and melted using the upper coil 12 to form a molten bath of magnesium and magnesium chloride. At this stage, the molten magnesium floats above the molten magnesium chloride and is separated therefrom by the difference in its specific gravity and by the magnetic field formed by the electromagnetic induction. Part of the molten magnesium chloride flows into any gap between the titanium alloy ingot 13 and the inner surface of the reaction vessel 2 where it cools and solidifies resulting in its functioning both as a pressure seal and an electrical insulator. Subsequently, the reaction vessel 2 is charged with argon gas to a predetermined pressure.

Thereafter, either at least two metal chlorides including titanium tetrachloride as the base metal compound, or titanium tetrachloride in which the required alloy component metals are suspended, and magnesium in liquid form are supplied through the feed pipes 6 and 5 respectively to the surface of a bath of the magnesium 16 floating above the above described molten bath, respectively.

In the apparatus shown in FIGS. 1 and 2, the magnesium is supplied from the feed pipe 5 in the upper portion of the reaction vessel 2 to the surface of the molten magnesium bath. Alternatively, however, the magnesium feed pipe 5 may communicate with the side of the reaction vessel 2 so that the magnesium may be supplied directly into the magnesium chloride bath.

The metal chlorides including titanium tetrachloride, or the titanium tetrachloride with the suspended alloy component metals supplied to the surface of the molten magnesium bath react in the liquid phase with the liquid magnesium. Alternatively, they may react in the vapour phase with magnesium vapour vaporized from the magnesium bath or liquid magnesium, resulting in a product 18 of the titanium alloy and a magnesium chloride by-product 17.

The temperature of the molten bath in the reaction vessel 2 is arranged to exceed the melting point of the titanium alloy through the heat of the reaction and electromagnetic induction heating. However, the reaction vessel 2 is kept at a pressure above the vapour pressure of magnesium at that temperature, so that the titanium alloy product 18, the magnesium chloride by-product 17 and the magnesium 16 are kept in a liquid state. They separate into layers of magnesium 16, magnesium chloride 17 and titanium alloy 18 in turn downwards from the surface of the molten bath.

The molten titanium alloy 18 produced precipitates and sinks through the molten magnesium and the magnesium chloride layers and reaches the molten top of the titanium alloy ingot 13. The molten titanium alloy product 18 is kept molten and is agitated by the lower electromagnetic induction heating coil 14, with the result that it is homogeneous. The product is then solidified as it is continuously drawn out, following the titanium alloy ingot 13 at a suitable rate.

The magnesium chloride by-product is discharged through the discharge pipe 15 at the side of the reaction vessel 2. The rate of discharge of the by-product is so adjusted that the amount of magnesium chloride remaining in the reaction vessel 2 can be kept constant.

Some of the magnesium chloride 17 flows into the gap between the inner surface of the reaction vessel 2 and the titanium alloy ingot 13 and solidifies there by cooling to form a layer which acts both as an electrical insulator for preventing electrical contact between the reaction vessel 2 and the ingot 13 and a pressure seal serving as a heat insulator. The insulating layer is often partially damaged when the titanium alloy ingot 13 is drawn out from the reaction vessel 2, however, fresh magnesium chloride 17 rapidly flows from the molten layer into the gap resulting in its being reformed or repaired. The molten product layer 18 is heated by the lower electromagnetic induction heating coil 14, during which its central portion tends to rise due to the induction. This helps the magnesium chloride 17 to flow readily into the gap between the reaction vessel 2 and the titanium alloy ingot 13, hereby facilitating the formation of the insulating and pressure sealing layer.

The titanium alloy ingot 13 is drawn out from the reaction vessel 2 at a rate corresponding to the rate of precipitation of the titanium alloy product onto the top of the ingot 13, by means of a roller (not shown), so that the position of the titanium alloy product 18 formed on the top of the ingot is kept constant. Reaction heat in the reaction vessel 2 is partially dissipated upwards towards the upper portion of the reaction vessel by radiation and convention, however, a large part of the heat is removed outwardly through the reaction vessel by the cooling agent.

Thus, the present invention is arranged so that the reaction zone is kept a temperature above a melting point of the titanium alloy product and at a pressure at least above the vapour pressure of the reducing metal agent at that temperature. This allows the reducing metal agent and its chloride to be kept in liquid form in the reaction vessel while being substantially prevented from boiling, so that the reduction may proceed efficiently.

Also, in the present invention, the titanium alloy is produced in molten form, whereby separation between the chloride of the reducing metal agent and the titanium alloy product and their recovery, are facilitated.

Furthermore, the present invention constantly ensures the presence of the liquid reducing metal agent in a suitable amount on the surface of the bath constituting the reaction zone, so that reduction of the metal chlorides occurs in a restricted region near the bath surface, unlike reduction in the gaseous phase. This means that the installations can be small in scale and their operation can be continuous leading to a significant decrease in costs as compared with the conventional consumable electrode type arc melting method. Also, the invention provides a titanium alloy product of high quality which has a uniform composition and is free of segregation.

The present invention will now be illustrated with reference to the following non-limiting Examples.

EXAMPLE 1

The example was carried out to produce Ti-6Al-4V alloy using an apparatus constructed in accordance with FIGS. 1 and 2.

The pressure vessel 1 was made of carbon steel, and the reaction vessel 2, constituted by segments 9 of 200 mm inner diameter was located in the pressure vessel 1.

Firstly, a titanium alloy ingot 13 having an outer diameter of 195 mm was inserted in through the lower open end of the reaction vessel so that the top of the ingot 13 was positioned at a level substantially corresponding to a central position of the lower electromagnetic induction heating coil 14. About 20 kg anhydrous magnesium chloride and about 4.5 kg metallic magnesium were charged onto the top of the titanium alloy ingot 13 from the upper part of the reaction vessel 2 and the pressure vessel 1 was immediately fully closed.

The pressure vessel 1 was evacuated by means of a vacuum pump and after it was confirmed that the pressure in the pressure vessel was reduced to $10^{-4}$ Torr, it was purged with argon gas. Subsequently, the upper and lower electromagnetic induction heating coils were turned on to start the electromagnetic induction heating.

The magnesium chloride and metallic magnesium were fully melted by the time the temperature of a molten bath at the reaction zone in the reaction vessel 2 had reached about 750° C., by the electromagnetic induction heating. Part of the magnesium chloride flowed into a gap between the titanium alloy ingot 13 and the inner surface of the reaction vessel 2 and solidified to form an insulating layer. Then the pressure in the pressure vessel 1 was raised to about 50 atms by means of argon gas.

Metal chlorides including titanium tetrachloride as a base metal compound were blended in the following ratios in a mixing tank made of stainless steel, to form a mixture.

| | |
|---|---|
| 1 Titanium tetrachloride | 88.93 wt % |
| 2 Aluminium trichloride | 7.67 wt % |
| 3 Vanadium trichloride | 3.21 wt % |
| 4 Ferric trichloride | 0.11 wt % |
| 5 Titanium oxide | 0.08 wt % |

When the temperature of the molten bath at the reaction zone reached 1327° C., the chloride mixture was supplied through the feed pipe 6 to the reaction vessel 2 in slurry form at a feed rate of about 7 kg/min by means of a slurry feed pump, and concurrently, magnesium in liquid form heated to about 800° C. was supplied through the feed pipe 5 to the reaction vessel 2 at a feed rate of about 1.8 kg/min.

Reduction started simultaneously with the supply of the reactants to the reaction vessel 2, generating heat of reaction, and resulting in the temperature of the molten bath rapidly increasing to about 1800° C. in a few minutes. Accordingly, the electromagnetic induction heating was controlled to keep the molten bath temperature at a level of about 1800° C., and at this point, the titanium alloy ingot was drawn out downwards at a rate of about 1.3 cm/min.

At the same time, the magnesium chloride by-product was successively discharged from the reaction vessel 2 through the discharge pipe 15 to keep the level of the molten bath substantially constant.

The operation proceeded stably and continuously about two hours under the conditions described above.

The continuous operation described above produced about 200 kg of the Ti-6Al-4V alloy product.

The titanium alloy obtained, as indicated in the Table 1, was of high quality and showed decreased segregation, compared with that obtained by the vacuum arc melting method.

TABLE 1

| | Chemical Composition (Weight %) | | | | | | | |
|---|---|---|---|---|---|---|---|---|
| Ti | Al | V | Fe | O | C | N | Cr | Ni |
| Present Invention | | | | | | | | |
| BAL | 6.18 | 4.13 | 0.148 | 0.185 | 0.005 | 0.003 | ≦0.001 | ≦0.005 |
| Prior Art | | | | | | | | |
| BAL | 6.39 | 4.15 | 0.148 | 0.168 | 0.007 | 0.007 | ≦0.01 | ≦0.02 |

EXAMPLE 2

A Ti-6Al-4V alloy ingot was produced using the same apparatus as in Example 1 but in this case, the alloy components, as an alloy and as elements in powder form, were suspended in titanium tetrachloride ($TiCl_4$) by mixing.

First, the reaction vessel 2 was charged with about 20 kg anhydrous magnesium chloride and about 4.5 kg metallic magnesium and was then rapidly purged with argon gas as in Example 1.

The anhydrous magnesium chloride and metallic magnesium were melted by electromagnetic induction heating and some of the anhydrous magnesium chloride formed a solid insulating layer between the titanium alloy ingot 13 and the inner surface of the reaction vessel 2. The pressure in the pressure vessel 1 was then increased to about 50 atms by means of argon gas.

The alloy powder and element powder were mixed with titanium tetrachloride in the following ratios in a mixing tank made of stainless steel to form a uniformly mixed liquid suspension.

| | | |
|---|---|---|
| 1 | Titanium tetrachloride | 97.08 wt % |
| 2 | 50% Al-50% V alloy powder (−200 mesh) | 2.25 wt % |
| 3 | Al powder (−200 mesh) | 0.55 wt % |
| 4 | Iron Powder (−200 mesh) | 0.04 wt % |
| 5 | Titanium oxide powder (−200 mesh) | 0.08 wt % |

The liquid suspension was supplied through the feed pipe 6 to the reaction vessel 2 at a feed rate of about 7 kg/min by means of a feed pump when the temperature of the molten bath at the reaction zone had reached 1327° C., and concurrently magnesium in liquid form heated to about 800° C. was supplied through the feed pipe 5 to the reaction vessel 2 at a feed rate of about 1.8 kg/min.

Reduction started simultaneously with the supply of the reactants and generated heat of reaction, so that the temperature of the molten bath rose rapidly and reached about 1800° C. in a few minutes. Accordingly, the electromagnetic induction heating was controlled to keep the molten bath temperature at a level of about 1800° C., and at this point, the titanium alloy ingot was drawn out downwards at a rate of about 1.3 cm/min.

The pressure in the reaction vessel was increased by about 1–2 kgf/cm$^2$ immediately after supply of the reactants. However, adjustment by the pressure adjusting valve 4 allowed the pressure to be returned readily to its original level.

At the same time, the magnesium chloride by-product was successively discharged from the reaction vessel through the discharge pipe 15 to keep the level of the molten bath substantially constant.

The operation proceeded stably and continuously about two hours under the conditions described above.

The continuous operation described above produced about 0.2 ton of the Ti-6Al-4V alloy.

It was found that the titanium alloy obtained, as indicated in Table 2, was of high quality and showed decreased segregation like that obtained in Example 1.

TABLE 2

| | Chemical Composition (Weight %) | | | | | | | | | |
|---|---|---|---|---|---|---|---|---|---|---|
| Ti | Al | V | Sn | Fe | Cr | Ni | O | N | C | H |
| BAL | 6.18 | 4.13 | 0.02 | 0.145 | 0.001 | 0.003 | 0.175 | 0.003 | 0.003 | 0.0008 |

EXAMPLE 3

Ti-5Al-2.5Sn which is widely known as an $\alpha$ titanium alloy in the art was produced in a manner similar to the Ti-6Al-4V described above.

As in Example 1, the reaction vessel 2 was charged with about 20 kg anhydrous magnesium chloride and about 4.5 kg metallic magnesium. Then, the anhydrous magnesium chloride and metallic magnesium were melted by electromagnetic induction heating and a solid insulating layer of anhydrous magnesium chloride was formed between the titanium alloy ingot 13 and the inner surface of the reaction vessel 2. Subsquently, the reaction vessel 2 is charged with argon gas to a predetermined pressure.

Chlorides of alloy component metals were mixed in the following ratios in a mixing tank made of stainless steel to produce a mixture in slurry form.

| | |
|---|---|
| 1 Titanium tetrachloride | 92.41 wt % |
| 2 Aluminium trichloride | 6.55 wt % |
| 3 Tin dichloride | 1.03 wt % |

The slurry suspension was supplied through the feed pipe 6 to the reaction vessel 2 at a feed rate of about 7 kg/min by means of a slurry feed pump when the temperature of the molten bath had reached 1327° C., and concurrently, magnesium in liquid form heated to about 800° C. was supplied through the feed pipe 5 to the reaction vessel 2 at a feed rate of about 1.8 kg/min.

The temperature of the molten bath at the reaction zone rose rapidly to a level above a melting point of titanium (1670° C.) within one minute and reached about 1800° C. in a few minutes. Accordingly, the electromagnetic induction heating was controlled to keep the molten bath temperature at about 1800° C., during which the titanium alloy ingot 13 was drawn out downwards at a rate of about 1.3 cm/min.

During operation, the pressure in the reaction vessel was kept constant by means of the pressure adjusting valve 4, and the magnesium chloride by-product was discharged from the reaction vessel through the discharge pipe 15 to keep the level of the molten bath substantially constant.

The operation proceeded for about two hours, producing about 0.2 ton of the Ti-5Al-2.5Sn alloy. It was found that the titanium alloy obtained, as indicated in the Table 3, was of high quality and showed decreased segregation.

TABLE 3

| | | | Chemical Composition (Weight %) | | | | | | | |
|---|---|---|---|---|---|---|---|---|---|---|
| Ti | Al | V | Sn | Fe | Cr | Ni | O | N | C | H |
| BAL | 5.24 | ≦0.01 | 2.52 | 0.02 | 0.001 | 0.002 | 0.012 | 0.004 | 0.004 | 0.0006 |

EXAMPLE 4

In example 3, Ti-5Al-2.5Sn alloy was produced using chlorides. In this example, it was produced using the metal alloy components in powder form.

Aluminum and tin powders were mixed with titanium tetrachloride at the following ratios in a mixing tank made of stainless steel to prepare a uniformly mixed liquid suspension.

| | |
|---|---|
| 1 Titanium tetrachloride | 97.91 wt % |
| 2 Aluminum powder (−200 mesh) | 1.40 wt % |
| 3 Tin powder (−200 mesh) | 0.69 wt % |

The liquid suspension was supplied to the reaction vessel 2 at a feed rate of about 7 kg/min under the same conditions as in Examples 1 to 3 and operation proceeded continuously for about two hours. This produced a Ti-5Al-2.5Sn alloy ingot of about 0.2 ton. The ingot obtained, as indicated in the Table 4, was of high quality and showed decreased segregation as in Example 3.

TABLE 4

| | | | Chemical Composition (Weight %) | | | | | | | |
|---|---|---|---|---|---|---|---|---|---|---|
| Ti | Al | V | Sn | Fe | Cr | Ni | O | N | C | H |
| BAL | 5.22 | ≦0.01 | 2.55 | 0.03 | 0.001 | 0.003 | 0.029 | 0.003 | 0.006 | 0.0008 |

Obviously, many modifications and variations of the present invention are possible in the light of the above teachings. It is therefore to be understood that within the scope of the appended claims, the invention may be practiced otherwise than as specifically described.

What is claimed as new and desired to be secured by Letters Patent of the United States is:

1. A method for producing a titanium alloy comprising titanium and at least one other alloy component metal, in which titanium tetrachloride is reduced using a reducing metal agent, comprising the steps of: maintaining a reaction zone in a reaction vessel at a temperature above the melting point of the titanium alloy to be produced and at above the vapour pressure of the reducing metal agent at that temperature; supplying the titanium tetrachloride, the reducing metal agent and the alloy component metals in metal form or in compound form to the reaction zone for reaction to produce the titanium alloy product and a chloride by-product of the reducing metal agent; separating the product and by-product from each other in the molten state; collecting the titanium alloy product at the bottom of the vessel; and continuously drawing out the titanium alloy product from the reaction vessel.

2. A method as claimed in claim 1 in which the alloy component metals are supplied in the form of chlorides of the metals.

3. A method as claimed in claim 2 in which the metal chlorides, the titanium tetrachloride and the reducing metal agent are supplied to the reaction zone in liquid form.

4. A method as claimed in claim 2 in which the metal chlorides and the titanium tetrachloride are supplied to the reaction zone in liquid form and the reducing metal is supplied to the reaction zone by injecting it into the molten bath.

5. A method as claimed in claim 2 in which the titanium tetrachloride the alloy component metals in metal form and the reducing metal agent are supplied in liquid form to the reaction zone.

6. A method as claimed in claim 2 in which the titanium tetrachloride and the alloy component metals in metal form are supplied in slurry form to the reaction zone and the reducing metal is supplied to the reaction zone by injection it into the bath of the chloride of the reducing metal agent.

7. A method as claimed in claim 1 in which the titanium alloy product is solidified by cooling as it is withdrawn to form an ingot.

8. A method as claimed in claim 1 including melting the separated titanium alloy product into a molten bath of titanium alloy previously formed on a bottom of the reaction vessel prior to withdrawing the titanium alloy product.

9. A method as claimed in claim 1 in which the reducing metal agent is magnesium or sodium.

10. A method as claimed in claim 1 in which the reaction pressure is above the sum total of the vapour pressures of the reducing metal agent and its chloride at the reaction temperature.

11. A method as claimed in claim 1 in which a portion of the chloride of the reducing metal agent is cooled and solidified in a gap between the inner surface of the reaction vessel and the titanium alloy ingot thereby forming a pressure seal and an electrical insulator for the bottom of the reaction vessel.

12. A method as claimed in claim 1 in which the temperature of the reaction zone is maintained at the desired level at least partially by electromagnetic induction heating means.

* * * * *